US009103124B2

(12) United States Patent
Spencer et al.

(10) Patent No.: US 9,103,124 B2
(45) Date of Patent: Aug. 11, 2015

(54) SHINGLE INSERTS AND METHOD FOR ELIMINATING AND PREVENTING GROWTH OF ALGAE, MOSS, OR LICHENS ON A ROOF

(71) Applicants: Laurie Anne Spencer, Commerce, MI (US); Mark Edgson, Prince George (CA)

(72) Inventors: David Spencer, Commerce, MI (US); Laurie Anne Spencer, Commerce, MI (US); Mark Edgson, Prince George (CA)

( * ) Notice: Subject to any disclaimer, the term of this patent is extended or adjusted under 35 U.S.C. 154(b) by 0 days.

(21) Appl. No.: 14/036,190

(22) Filed: Sep. 25, 2013

(65) Prior Publication Data

US 2014/0338284 A1 Nov. 20, 2014

Related U.S. Application Data

(63) Continuation of application No. 13/546,056, filed on Jul. 11, 2012, now abandoned.

(51) Int. Cl.

| | |
|---|---|
| ***E04D 13/00*** | (2006.01) |
| ***E04D 13/18*** | (2014.01) |
| ***E04B 1/62*** | (2006.01) |
| ***E04D 1/00*** | (2006.01) |
| ***E04D 7/00*** | (2006.01) |

(52) U.S. Cl.

CPC ..... *E04D 13/002* (2013.01); *E04D 7/005* (2013.01); *Y10T 428/12361* (2015.01)

(58) Field of Classification Search

CPC ... E04D 13/002; E04D 2001/005; E04D 1/26; E04D 5/12; E04D 7/005; E04D 13/00; E04D 13/0459; E04D 1/00; E04D 1/06; E04D 2001/3414; E04D 5/10; C04B 2111/00586

USPC ..... 52/173.1, 741.3, 12, 14, 515–517, 533, 52/534

See application file for complete search history.

(56) References Cited

U.S. PATENT DOCUMENTS

| | | | | |
|---|---|---|---|---|
| 3,479,130 | A * | 11/1969 | Rapaport | 424/413 |
| 3,998,644 | A * | 12/1976 | Lodge | 106/18.36 |
| 4,381,630 | A * | 5/1983 | Koester | 52/169.5 |
| 5,216,864 | A * | 6/1993 | Urgero | 52/515 |
| 6,447,390 | B1 * | 9/2002 | O'Hagin | 454/250 |
| 7,788,870 | B1 * | 9/2010 | Spencer | 52/518 |
| 8,104,247 | B2 * | 1/2012 | Hasse | 52/746.11 |
| 8,703,166 | B1 * | 4/2014 | Flynn | 424/409 |
| 2003/0150170 | A1 * | 8/2003 | Weber | 52/1 |
| 2004/0255548 | A1 * | 12/2004 | Hong et al. | 52/747.1 |

(Continued)

*Primary Examiner* — Phi A
*Assistant Examiner* — Omar Hijaz
(74) *Attorney, Agent, or Firm* — John R. Benefiel

(57) ABSTRACT

A shingle insert and method for eliminating and preventing growths on a shingled roof in which copper strips forming the inserts are installed with an upper edge disposed beneath a course of shingles with the remaining portions of the insert exposed. The insert strips have a confined space defined beneath a stiffening lengthwise extending arched hump formed in the exposed copper strip portions which has an array of elongated indentations formed therein with slits therein to allow slow drainage of water impounded by the arched hump through the inserts may contain a growth toxic material, in solid or granular form which releases a substance toxic to the growths when rainwater runoff passes into the confined space and over the material and thereafter flows out down the roof.

11 Claims, 4 Drawing Sheets

(56) References Cited

U.S. PATENT DOCUMENTS

| | | | | |
|---|---|---|---|---|
| 2005/0084665 | A1* | 4/2005 | DiChiara | 428/293.4 |
| 2007/0020436 | A1* | 1/2007 | Teng et al. | 428/148 |
| 2007/0039252 | A1* | 2/2007 | Railkar et al. | 52/44 |
| 2007/0148340 | A1* | 6/2007 | Kalkanoglu et al. | 427/209 |
| 2008/0008858 | A1* | 1/2008 | Hong et al. | 428/143 |
| 2008/0248246 | A1* | 10/2008 | Shiao et al. | 428/147 |
| 2009/0071849 | A1* | 3/2009 | Trusiak | 206/77.1 |
| 2009/0151287 | A1* | 6/2009 | Fink | 52/518 |
| 2010/0239816 | A1* | 9/2010 | Kinkade | 428/142 |
| 2011/0174365 | A1* | 7/2011 | Drake et al. | 136/255 |
| 2012/0227347 | A1* | 9/2012 | Kalkanoglu et al. | 52/543 |

* cited by examiner

SHINGLE INSERTS AND METHOD FOR ELIMINATING AND PREVENTING GROWTH OF ALGAE, MOSS, OR LICHENS ON A ROOF

CROSS REFERENCE TO RELATED APPLICATION

This application is a continuation in part of U.S. patent application Ser. No. 13/546,056 filed on Jul. 11, 2012 which is a continuation in part of U.S. patent application Ser. No. 13/329,729 filed on Dec. 19, 2011, which claims the benefit of U.S. provisional patent application No. 61/424,892 filed on Dec. 20, 2010, incorporated herein by reference.

BACKGROUND OF THE INVENTION

This invention concerns protecting and treating shingled roofs for deterring the growth of algae, moss, lichens or fungus. Such growths can be unsightly and also damage asphalt shingles by loosening the granules embedded therein which loss shortens the service life of a shingled roof.

Also, water is retained by such growths delaying complete dry out of the roof after a rain and such, the prolonged contact with moisture also contributes to early wear out of the roof covering.

It has long been known that copper strips installed on the roof will deter such growths.

Spraying algaecides on the roof shingles can quickly kill those growths which have built up over a period of years.

Copper or zinc strips have long been used to inhibit such growths on roof coverings. These strips are often only effective for a few courses of shingles such that multiple rows of strips are required. In addition, these strips act slowly and cannot quickly eliminate an existing buildup of such growths if the strips are installed much later after the roof itself has been installed.

The object of the present invention is to provide a more effective shingle insert strip configuration for such applications which also can provide for elimination of a preexisting buildup of growths as well as inhibit the start of such growths on roofs for a greater distance down the roof.

SUMMARY OF THE INVENTION

The above recited object as well as other objects which will be understood by one skilled in the art upon a reading of the following specification and claims are achieved by a shingle insert, preferably constructed of formed copper sheet strips which could optionally be combined with an underlayer of a strip of copper mesh. The copper sheet strip portion is formed with a lengthwise extending raised arched hump intermediate its width to be located just below the shingle edge which covers an upper section of the copper strip. The arched hump thus will temporarily impound a portion of the dew or rainwater moving down the roof to lengthen the time that the water remains in contact with the copper. The arched hump as well as the remainder of the copper strip is formed with a pattern of elongated indentations extending lengthwise along the strip. The indentations form slits on either side thereof allowing rainwater to trickle through after being captured in the indentations.

This enhances the formation of copper ions in the rainwater flowing down the roof.

A strip of roofing material can also be adhered to the roof shingles to be disposed beneath the copper strip and having a section underlying the arched hump, which has granules of algaecide adhered thereto in the section lying beneath the arched hump.

A copper screen formed with a tubular pocket along its lower edge can optionally and alternatively be disposed within the arched hump. The tubular pocket can receive a rod of algaecide implaced therein which will be absorbed by rainwater flowing beneath the copper strip and over the inserted rod.

The copper screen strip extends above the upper edge of the copper sheet strip and beneath a course of shingle to provide a nailing tab and is secured as with an adhesive to the copper sheet strip the space beneath the hump is adapted to enclose a mass of a chemical algaecide such as a copper compound that will relatively quickly kill the growths described when absorbed by rainwater descending the roof which passes through and over the chemical and releases a substance powerful enough to quickly kill existing roof growths. The copper strips will release copper ions which will continue to inhibit the reestablishment of growths for long periods.

As noted above, the shingle insert strip portions are configured to have crosswise oriented elongated indentions which also capture moisture with the sides forming narrow slots which allow slow penetration of rainwater runoff through the strip. The slots are narrow enough so that surface tension creates a tendency to hold dew or rainwater briefly to increase the time of residence of water in contact with the copper.

The lengthwise arched hump feature also has a tendency to impound the rainwater runoff to create substantial contact of the water with the algaecide chemical material to create a greater degree of absorption.

The optional bottom layer of copper mesh underlies the copper sheet strip to close off the space defined by hump, creating a confined space to retain granules or to enclosure a solid rod during handling and installation while allowing through flow of rainwater and easing the installation of the strips.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
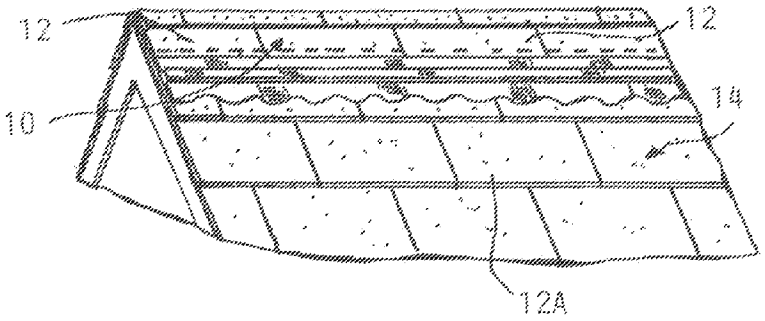
FIG. 1 is a fragmentary pictorial view of a section of a shingled roof having a single course of shingle inserts according to one embodiment of the present invention installed thereon.

Referring to the Drawings, FIG. 1 shows a series of roofing shingle inserts 10 according to one embodiment of the invention, installed on a roof with an upper projecting edge portion nailed beneath a course of shingles 12 near the top of the roof 14, with a main portion overlying the next lower course of shingles 12A.

One or more additional courses of roofing shingle inserts 10 may be installed in shingle courses at locations down the roof as necessary, but the improved effectiveness of the strips according to the invention minimizes such need.

Figure 2:
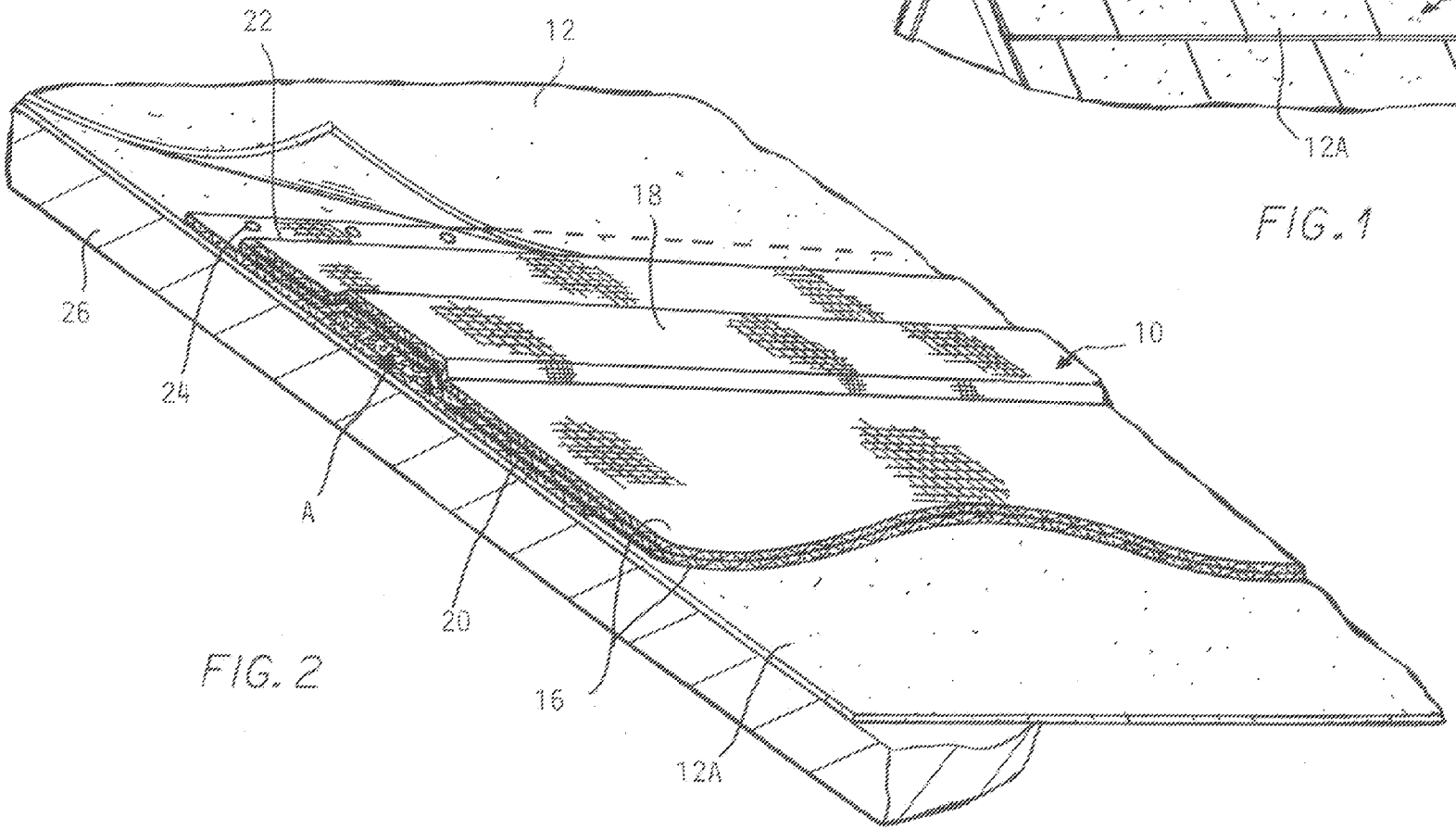
FIG. 2 is an enlarged partially broken away pictorial view of one embodiment of shingle insert of the invention installed over a roof section.

FIG. 2 shows additional details of one embodiment of the roofing shingle inserts 10, each includes a doubled outer layer 16 of copper mesh.

The lower edge thereof has a series of gentle scallops is provided for allowing a substantial area exposed dew or to rainwater runoff to increase the formation of copper ions to enhance the long term effects thereof in keeping the roof clear of growths while presenting an aseptically acceptable appearance.

A lengthwise hump 18 is formed into the top outer layers 16 for the full length of each of the shingle insert strips 10. A bottom under layer 20 of copper mesh extends beneath the double layers 16 and protrudes above the upper edge 22 of the double layers 16, and covers the bottom of the space A formed by the lengthwise hump 18 to allow retention of chemical material in the space as described below.

The undercover layer 20 is preferably attached to the upper layers 16 as with adhesive caulk, soldering or spot welding.

The protruding upper edge 24 of the bottom layer 20 is inserted beneath the lower edge of the course of shingles 12, which can be raised up to enable nailing the strip 24 through the upper part of the next down course of shingles 12A and into the roof deck 26 as shown.

The confined space A is initially filled with granules of an algaecide material which will dispense an algaecide substance down the roof by rainwater percolating through the shingle insert strip openings and also through the granules themselves.

A preferred algaecide is described in U.S. Pat. No. 3,930,834, incorporated herein by reference, which is commercially available under the trademark CUTRINE-PLUS™ available from Applied Biochemists of Germantown, Wis. This material is described as a "copper complex" which releases elemental copper.

This material dispenses copper into rainwater runoff which results in a rapid die off of the various growths, i.e. moss, algae, lichens, which can grow on roofs.

Long term growth control is provided by the ions released into the moisture by the copper metal which forms the shingle insert strips 10.

Figure 3:
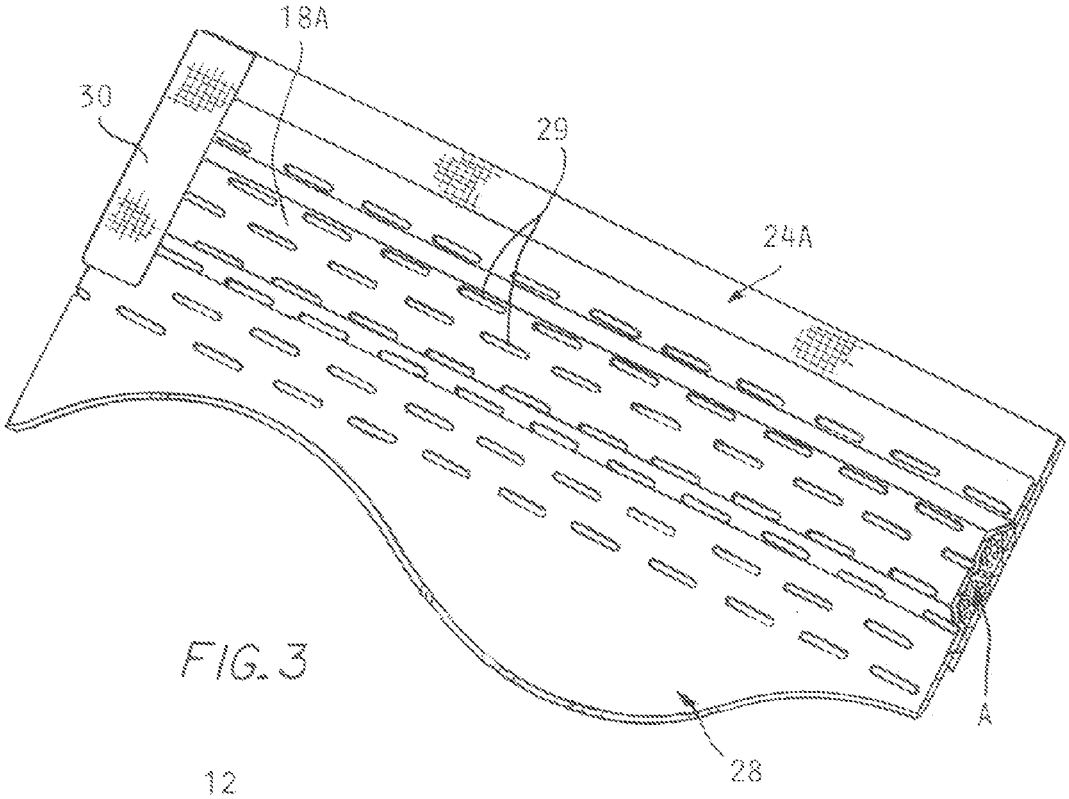
FIG. 3 is a fragmentary pictorial view partially broken away of another embodiment of a shingle insert according to the invention.

Another embodiment of a shingle insert strip 27 is shown in FIG. 3, in which a copper sheet strip 28 is used which has a series of elongated indentations 29 formed thereby to allow rainwater to penetrate through the sheet and into a lengthwise arched hump 18A and into space A which is packed with algaecide granules as described above.

A copper mesh bottom strip 24A is attached to close off the space A and hold the granules therein.

The strip 24A has a protruding edge for nailing as in the above described embodiment.

The ends 30 of the strip 24A are wrapped over the ends (only one end shown) to close off the ends of the space A and prevent escape of the algaecide granules.

The sheet 28 is also formed with a series of scallops 29 along its bottom edge to provide a large area exposed to moisture run off while maintaining a good appearance.

Figure 4:
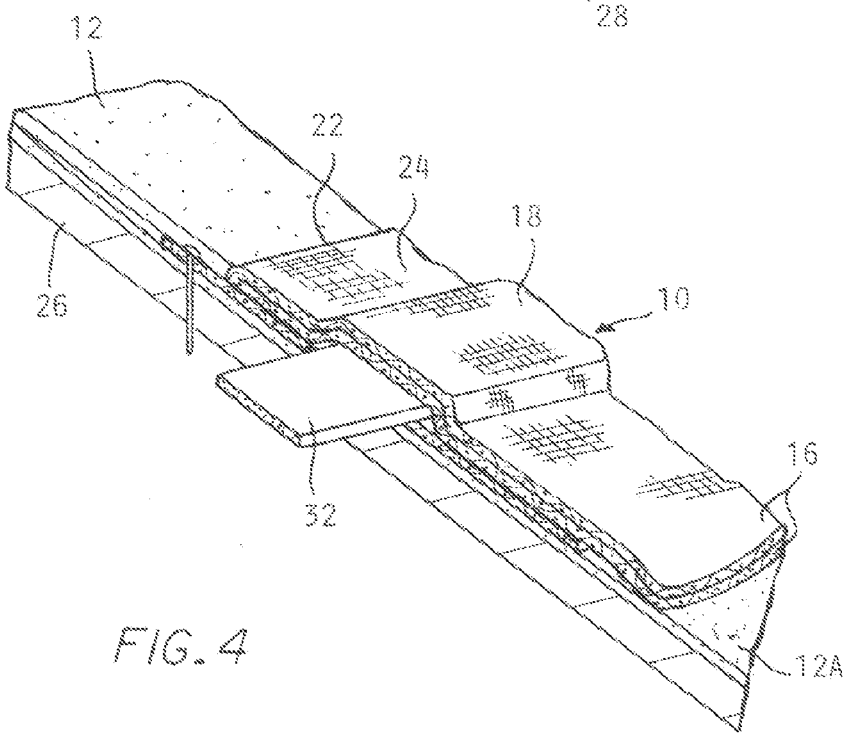
FIG. 4 is an enlarged partially broken away pictorial view of a shingle insert installed on a roof section containing a solid mass of algaecide chemical material.

As shown in FIG. 4, the algaecide could be formed into a solid rod 32 inserted beneath the hump 16.

The arched hump 18 tends to briefly impound the dew and rainwater runoff so as to increase the time of contact of water with the copper metal and enhance the inhibiting effect on any growths on the roof in the manner generally known.

Figure 5:
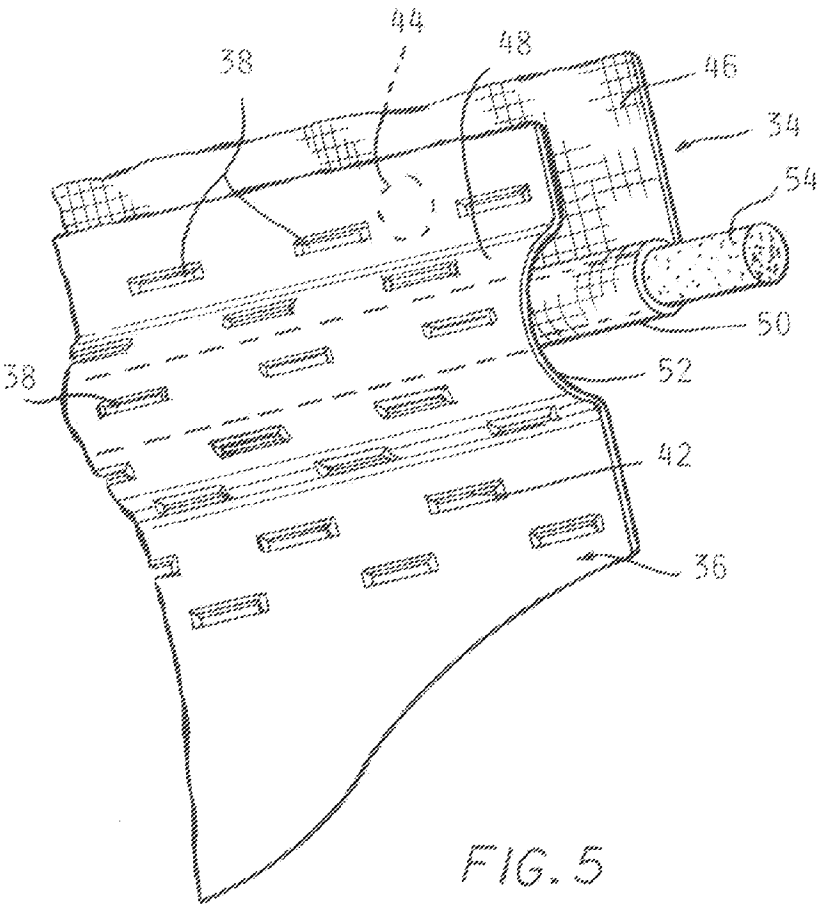
FIG. 5 is a fragmentary pictorial broken away view of another embodiment of a shingle insert strip according to the present invention.
Figure 6:
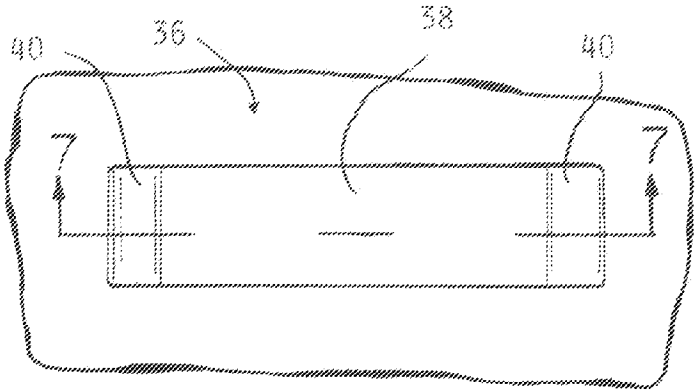
FIG. 6 is an enlarged plan view of one of the depressions formed into the copper insert strip shown in FIG. 5.
Figure 7:
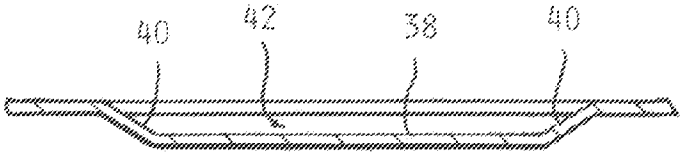
FIG. 7 is an enlarged view of a section 7-7 taken though the depression shown in FIG. 6.

Referring to FIGS. 5-7, another embodiment of a shingle insert 34 is shown, which includes a top strip 36 of thin copper sheet (approximately 1/32 of an inch thick) several inches wide.

Several lengthwise rows of narrow indentions 38 are formed therein. The ends of the indentions 38 are sloped at the ends 40 so that the metal at the ends remains attached to the sheet.

On each of the sides, the indentions 39 (which are about ½ inches long) are formed with a vertical shape such that the metal tears to form narrow slots 42 on the order of slightly over 1/32 inch high which is the approximate depth of the slots 42. These narrow slots allow water received in the indentions 38 to seep out after some delay to increase the time in residence of the water from dew or rain remains in contact with the copper metal of the sheet strip for some period of delay.

Thus, a greater concentration of copper ions are released into the water which moves down onto the shingles below enhancing the growth inhibiting effect.

This growth inhibiting effect has been found to extend for relatively great distances down the roof, often allowing a single course of inserts to protect entire sections of a protected roof.

A copper mesh underlayer strip 46 is optionally secured as by adhesive caulk patches 44 to an upper portion of the copper sheet strip 36 and protruding above the upper edge, providing a nailing strip 46, which is inserted beneath the lower edge of a course of shingles.

A semi tubular arched hump 48 is formed into the copper sheet strip 36 intermediate its width as measured uproof extending the complete length of the insert thereof. This provides an effect of impounding temporarily runoff water as in the above embodiments.

The optional copper mesh underlayer 46 has a lower side rolled into a tube 50 which is disposed within the space 52 defined beneath the hump 48.

In addition the substantial size of the arched hump 48, i.e. about one inch wide and a height of about one half inch creates a substantial stiffness of the copper strip roof insert which will greatly minimize and bending deformation so as to maintain straightness when installed to have an acceptable appearance when installed on a roof.

A rod of solid algaecide 54 can be inserted into the tube 50 as shown in FIG. 5 if there is an existing heavy growth on the roof when the shingle inserts 34 are being installed.

Figure 8:
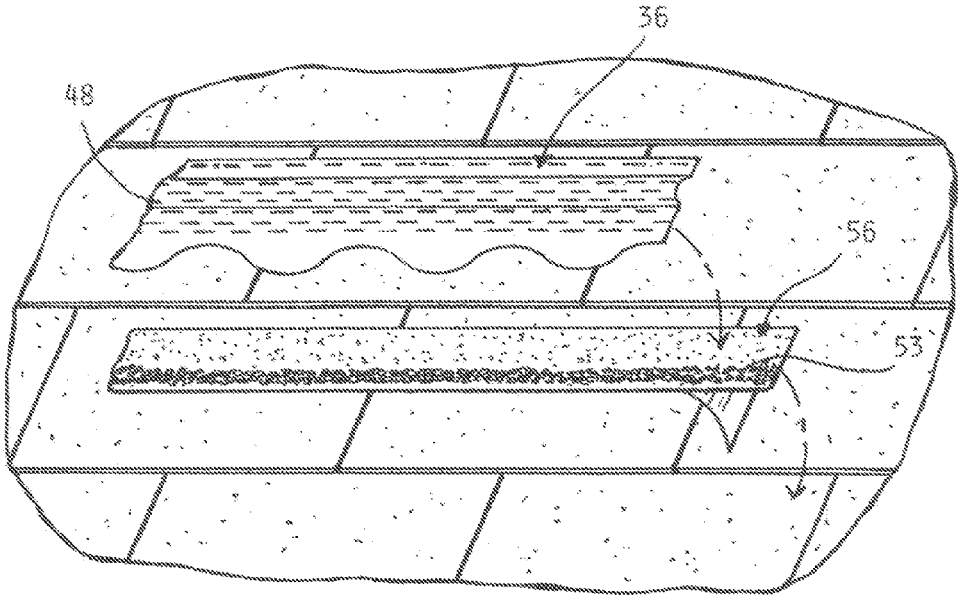
FIG. 8 is an exploded pictorial view of a copper strip according to a variation of the invention spaced above a shingled roof section with a roofing strip carrying algaecide granules which is to be covered by the copper strip.
Figure 9:
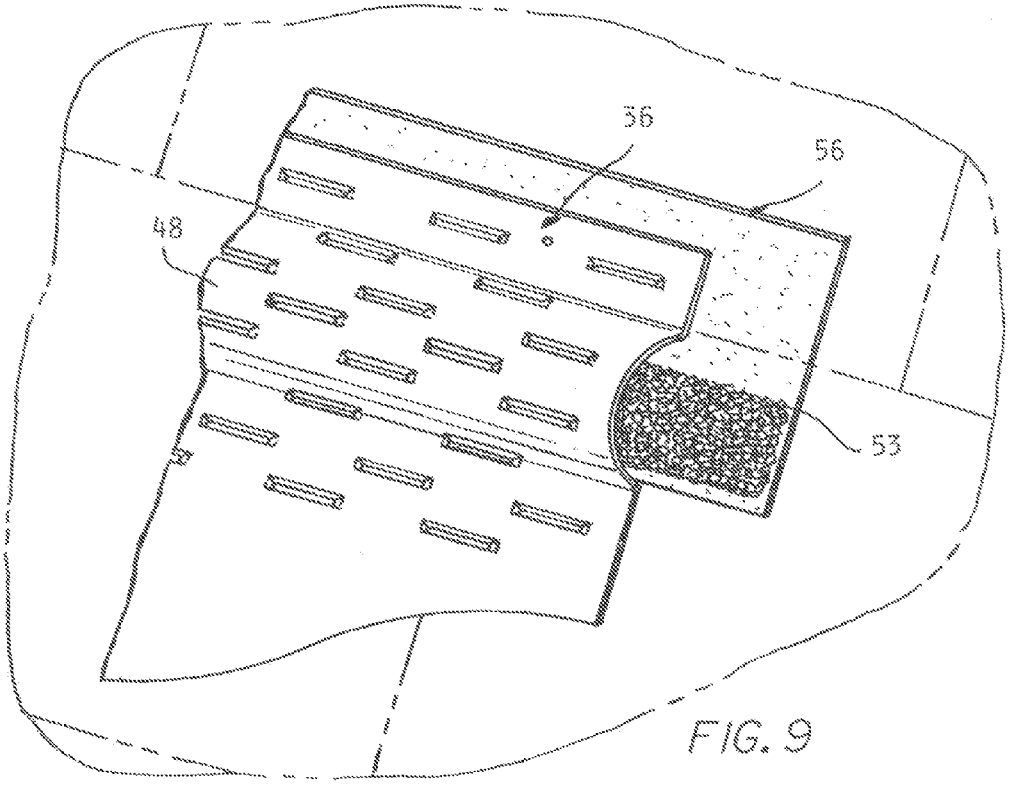
FIG. 9 is an enlarged fragmentary view of one end of the copper strip positioned on a roofing strip installed on a shingled roof.

The copper strip 36 can be used without the copper mesh where the need for such mesh does not justify its cost, as shown in FIGS. 8 and 9.

In addition, another arrangement for holding algaecide material is shown, comprised of an adhesive strip 56 of roofing material which has a band 53 of algaecide granules adhered at a location beneath the arched hump 48 where water runoff penetrating through the arched hump will come into contact therewith and thereafter absorb algaecide prior to running down over the shingles.

The invention claimed is:

1. A shingle insert strip for inhibiting the growths of algae, moss, lichens, or fungus on shingled roofs comprising:

an elongated generally planar insert strip of a sheet of metal which releases ions into rainwater runoff flowing thereover so as to inhibit said growths on shingled roofs, said insert strip having a raised feature formed therein disposed at a location intermediate the width of said insert strip and extending continuously along the length thereof, said insert strip having a flat upper portion located above said raised feature when said insert strip is installed, said insert strip also having a lower flat portion located below said raised feature when said insert strip is installed, said upper and lower portions, extending along the complete length of said insert strip, said raised feature creating a lengthwise extending continuous impoundment when said insert strip is installed which is configured to intercept and impound said rainwater runoff flowing down shingles on a roof on which said insert strip is installed, said formed raised feature also defining a lengthwise extending underspace located beneath said insert strip and providing a reinforcement of said insert strip, stiffening said insert strip against bending of the insert strip across the width thereof when being installed;

said insert strip having openings allowing a portion of said rainwater runoff flowing onto said insert strip to flow through said insert strip including through said raised feature of, said portion of said rainwater runoff flowing into said underspace, and flowing out thereafter onto said lower flat portion and onto a roof surface below said insert strip;

said shingle insert strip upper portion adapted to be inserted and nailed beneath a course of shingles above said shingle insert strip leaving said lower portion and said raised feature of said insert strip outer surface exposed to receive rainwater runoff flowing down over said course of shingles.

2. The insert strip according to claim 1 further including a roof growth control material held in said underspace beneath said insert strip, which releases a substance into said rainwater runoff entering said underspace said water retained in contact with said substance by the lower portion of said insert strip slowing the flow of water out of said underspace.

3. The shingle insert strip according to claim 1 wherein a strip of copper mesh is affixed to said insert strip upper portion.

4. The shingle insert strip according to claim 1 wherein said insert strip is formed of a copper material with an array of shallow horizontal indentations formed in said insert strip including along said raised feature and said lower portion thereof to temporarily capture rainwater runoff therein.

5. The shingle insert strip according to claim 3 wherein said copper mesh strip is attached to an undersurface of said upper portion of said insert strip.

6. The shingle insert strip according to claim 4 wherein said insert strip indentations are shaped as elongated horizontally extending rectangles with elongated slits along upper and lower sides of said indentations.

7. The shingle insert strip according to claim 2 wherein said material is in granular form.

8. The shingle insert strip according to claim 6 wherein said material is a copper compound.

9. The shingle insert strip according to claim 1 wherein said insert strip is formed of copper and has a scalloped lower edge lying on said lower portion of said insert strip.

10. The shingle insert strip according to claim 2 further including a copper mesh strip extending into said underspace, said copper mesh strip having a lower side formed into a loop adapted to receive a rod formed from said roof growth control material.

11. The shingle insert strip according to claim 2 further including a roofing strip attached to a shingled roof, said insert strip extending over said roofing strip with said roof growth control material deposited on a portion of said roofing strip with said formed raised feature covering said growth control material.

* * * * *